US005605269A

United States Patent [19]

Musiani

[11] Patent Number: 5,605,269

[45] Date of Patent: Feb. 25, 1997

[54] APPLIANCE FOR DRIVING SHARP POINTED FASTENER ELEMENTS INTO OBJECTS

[75] Inventor: Gianfranco Musiani, Monteveglio, Italy

[73] Assignee: FIMCA S.r.L., Bologna, Italy

[21] Appl. No.: 185,902

[22] PCT Filed: May 10, 1993

[86] PCT No.: PCT/IT93/00048

§ 371 Date: Jan. 21, 1994

§ 102(e) Date: Jan. 21, 1994

[87] PCT Pub. No.: WO93/23209

PCT Pub. Date: Nov. 25, 1993

[30] Foreign Application Priority Data

May 21, 1992 [IT] Italy ..... BO92A0195

[51] Int. Cl.[6] ..... B25C 5/16

[52] U.S. Cl. ..... 227/109; 227/119; 227/120

[58] Field of Search ..... 227/109, 119, 227/120

[56] References Cited

U.S. PATENT DOCUMENTS

| | | | |
|---|---|---|---|
| 1,588,990 | 6/1926 | Polzer et al. . | |
| 2,909,780 | 10/1959 | Wandel | 227/130 |
| 3,347,439 | 10/1967 | Doherty | 227/109 |
| 3,348,752 | 10/1967 | Wheble | 227/109 |
| 3,510,043 | 5/1970 | Larson | 227/109 X |
| 3,633,811 | 1/1972 | Ploen | 227/109 |
| 3,958,738 | 5/1976 | Tremblay | 227/109 |
| 4,556,161 | 12/1985 | Oide | 227/109 X |
| 4,667,865 | 5/1987 | Judge | 227/109 |
| 4,693,407 | 9/1987 | Buck et al. | 227/109 |
| 4,732,309 | 3/1988 | Judge | 227/109 |

FOREIGN PATENT DOCUMENTS

| | | |
|---|---|---|
| 0040157 | 11/1981 | European Pat. Off. . |
| 28008 | 2/1884 | Germany . |
| 3817862 | 2/1989 | Germany . |

*Primary Examiner*—Joseph J. Hail, III
*Assistant Examiner*—Jay A. Stelacone
*Attorney, Agent, or Firm*—Darby & Darby

[57] ABSTRACT

A hand-held appliance (1) includes a tubular element (17) to accommodate a bonded strip (36) of staples or tacks (14*a* . . . *e*). A guide bar (18) is positioned internally of the tubular element (17) along which the refill strip (36) is slidable. A spring-loaded element (27) pushes the strip (36) in the direction of a restraining plate (30) located at one end of the tubular element (17), and a punch rod (7) separates the staples or tacks singly from the strip and drives them downwards, sliding against the surface of the plate (30). The top part of the guide bar (18) is chased with a longitudinal and vertically disposed groove (21), while the restraining plate (30) affords one or more slits or grooves (32 or 33*a*, 33*b*) in which to seat at least one leaf spring (33' or 33*a*, 33*b*) extending toward the longitudinal groove (21), or lower, and serving to maintain the correct position of the staple or tack as the rod (7) moves downwardly.

20 Claims, 2 Drawing Sheets

APPLIANCE FOR DRIVING SHARP POINTED FASTENER ELEMENTS INTO OBJECTS

ART FIELD

The present invention relates to an appliance for driving sharp pointed fastener elements into objects.

In particular, the invention relates to an item of equipment generally described as a gun, referred to also herein as a tacker or tacking appliance, by means of which fastener elements with sharp points present typically in nails, pins and staples of different sizes and shapes, can be driven into wood, plastics and similar materials. The fastener elements in question are graded according to size (length, gauge, etc.) in a number series, each designating a range of fasteners rated as nominally compatible, or rather comparable one with another, as regards the type of use and holding power.

BACKGROUND ART

Conventionally, the different types of fastener elements referred to above (which will be described more fully in due course) are driven into an object and a support together, for example so as to secure the former to the latter, by means of a suitable pneumatic, electromechanical or entirely mechanical (spring-loaded) tacking appliance. Such appliances are designed traditionally to operate with a single type of fastener, i.e. a nail or pin or staple of precise shape and dimensions, so that in situations where there is a need to use dissimilar fasteners for different purposes, there must also be a number of separate appliances ready to hand, each able to operate with a particular type of fastener.

Clearly, such a constraint occasions notable cost disadvantages, and reflects a current state of the art whereby users needing to operate with more than one of the aforementioned types of fastener element are obliged also to purchase or acquire a different appliance for each type.

Accordingly, the object of the invention is to overcome the drawback mentioned above by providing an appliance of the type in question that will operate universally with a variety of sharp pointed fastener elements, provided that all are of the same nominal size and strength.

BRIEF DESCRIPTION OF THE DRAWINGS

The invention will now be described in detail, by way of example, with the aid of the accompanying drawings, in which.

DETAILED DESCRIPTION OF THE INVENTION

Figure 1:
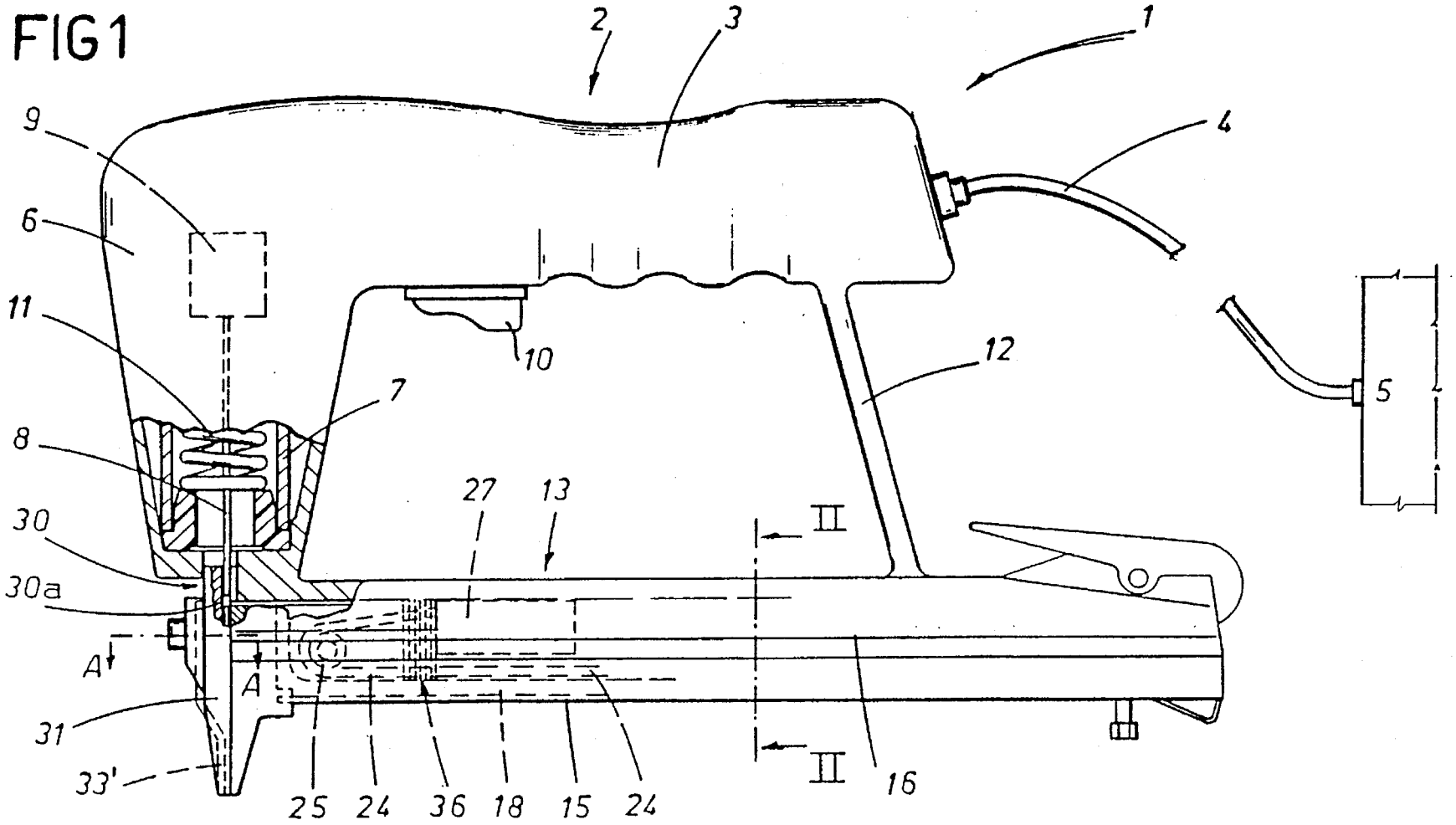
FIG. 1 is a schematic representation of an appliance according to the present invention, shown in a side elevation and partly in section.

Referring to FIG. 1 of the drawings, 1 denotes a tacking appliance, in its entirety, comprising a substantially horizontal upper housing 2 of which the portion located center-right, in FIG. 1, affords a handgrip 3. The horizontal housing 2 incorporates a chamber (not illustrated) connected by way of a hose 4 with a compressed air supply schematically denoted 5, and communicating at bottom (on the left in FIG. 1) with the uppermost part of a vertically disposed second hollow body 6 by which a forcing element 7 is slidably accommodated and supported in a conventional manner (not illustrated).

The forcing element 7 is shown as a flat rod 8, vertically disposed and occupying a plane normal to the viewing plane of FIG. 1, of which the top end is connected in conventional manner (not illustrated) to an actuator element indicated schematically by the block denoted 9. Thus, the forcing element 7 can be provided with an impulsive downward movement each time the actuator element 9 is connected to the compressed air supply 5 by squeezing a manually operated control or trigger 10. A portion of the flat rod 8 accommodated internally of the vertical housing 6 is encircled, likewise in conventional manner, by a coil spring 11 loaded in such a way as to compress during each impulsive downward stroke of the forcing element 7 produced by operating the control 10, spring 11 causes the flat rod 8 to be returned subsequently to a raised at-rest position.

The above description relates in particular to a pneumatically operated tacker or staple gun, this clearly being the type in most widespread use, but applies equally well to an electromechanical type of appliance or even to an all-mechanical gun, for example with a spring-loading action.

Also forming part of the tacker is a magazine assembly 13, associated at one end with the bottom portion of the vertical housing 6 and supported at the remaining end by a strut 12 extending from the bottom of the horizontal housing 2 (on the right, in FIG. 1). Magazine 13 hold a plurality of sharp pointed fastener elements to be directed in succession toward the bottom end of the forcing element 7. The single fastener element may be one of various types, respectively denoted 14*a* (broad staple), 14*b* (narrow staple), 14*c* (flat pin with rounded head, or brad), 14*d* (flat and headless pin, or sprig) and 14*e* (medium width staple) in FIGS. 3 to 7.

Figures 2, 3, 4, 5, 6, 7, 8:
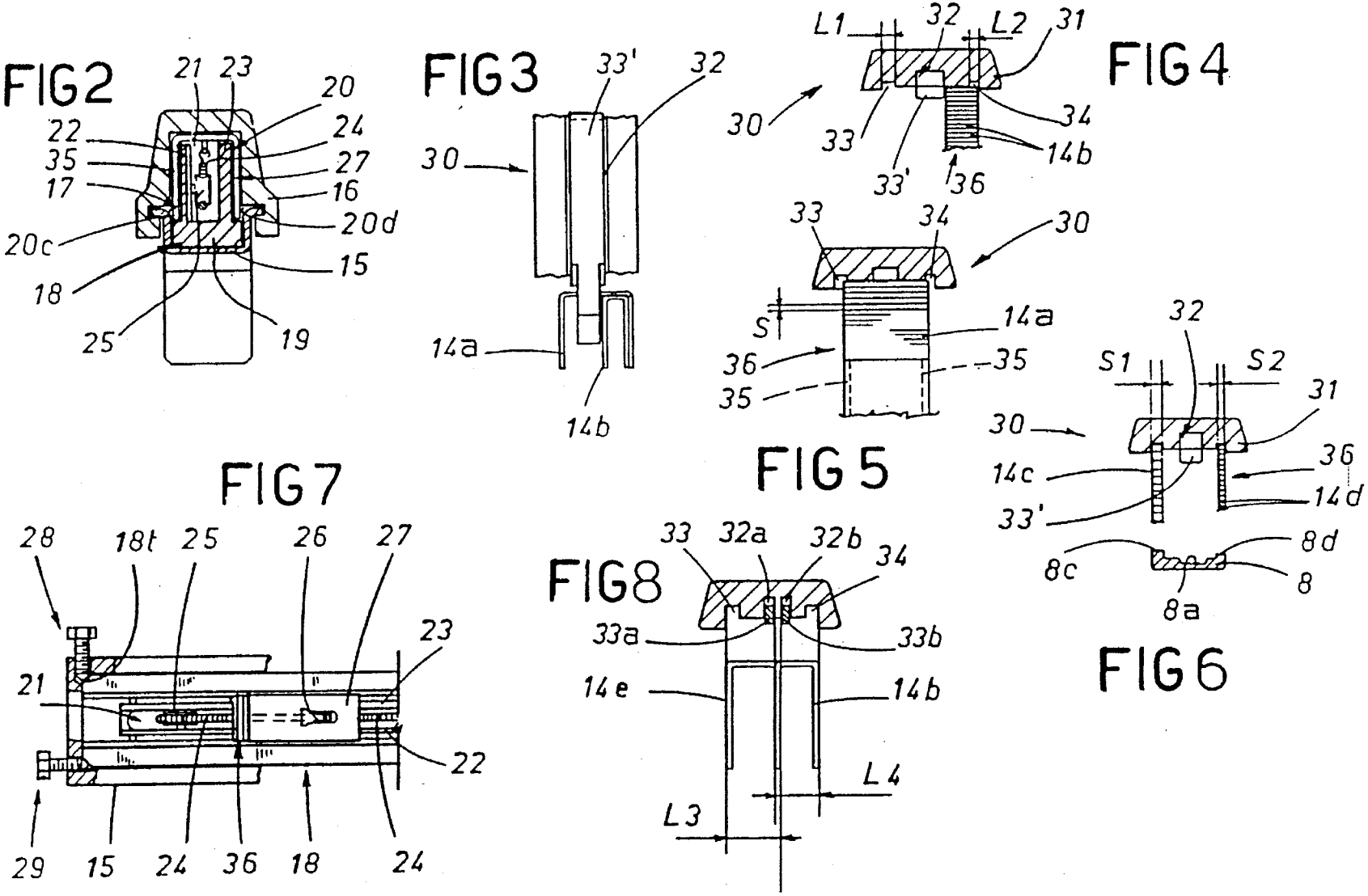
FIG. 2 shows certain of the parts of an appliance according to the invention, seen from the vertical cutting plane denoted II—II in FIG. 1.
FIG. 3 shows a detail of the appliance of FIG. 1, enlarged and in a front elevation.
FIGS. 4, 5 and 6 illustrate further parts of an appliance according to the present invention, seen in a horizontal section through A—A, FIG. 1.
FIG. 7 shows a detail of the appliance of FIGS. 1 to 6, viewed in plan from above and with certain parts omitted in the interests of clarity.
FIG. 8 shows a detail of the forwardmost part of the appliance disclosed, in an alternative and preferred embodiment.

As seen in FIGS. 1 and 2, the magazine assembly 13 comprises a first channel element 15, occupying a fixed position relative to the housing 2 and having a horizontal member of substantially U-shaped cross-sectional profile disposed with the concave surface facing upwardly. The longitudinal edges of this first channel element 15 are rigidly associated with the longitudinal edges of a second fixed channel element 16, having a horizontal member rigidly associated with the vertical housing 6 and the strut 12 and exhibiting a substantially U-shaped cross-sectional profile, of which the concave surface is directed downwards. The two channel elements 15 and 16 thus combine to create an elongated tubular element 17 extending horizontally in a direction parallel to the axes of the elements 15 and 16.

The magazine assembly 13 further comprises a guide element lodged internally of the tubular element 17, disposed parallel with and capable of axial motion in relation to the two channel elements 15 and 16 (as will be described in due course). The said element includes a bar 18 of basically rectangular parallelepiped geometry projecting above the plane occupied by the edges of the first channel element 15 (see FIG. 2). The guide bar 18 comprises a lower portion 19 of essentially rectangular cross section, accommodated within the first channel element 15, which is surmounted by a rigidly associated portion 20 likewise essentially rectangular in section but exhibiting a transverse dimension less than that of the lower portion 19 and affording a longitudinal vertically disposed chase 21 extending the full length of the bar 18 in the axial direction and from the topmost face of the upper portion 20 down to the upwardly directed horizontal surface of the lower portion 19 in the vertical direction. The upper portion 20 is thus divided by the chase 21 into two ribs 22 and 23 disposed one alongside the other, respectively left and right as seen in FIG. 2, of which the latter is marginally narrower, measured horizontally in the transverse direction, than the distance separating the two shanks of a fastener element of the type denoted 14*b* (narrow staple).

The position of the upper portion 20 relative to the lower portion 19 is non-symmetrical, with the result that the guide bar 18 is flanked by two spaces or gaps 20*c* and 20*d* of dissimilar widths, proportional respectively to the transverse dimensions S1 and S2 of the fastener elements denoted 14*c* and 14*d*, of which the purpose will be described in due course.

The longitudinal chase 21 is occupied by a coil spring 24 tensioned by expansion, of which one end is anchored to the part of the magazine assembly 13 on the right of FIG. 1, and the remaining end (that on the left, in FIG. 1) is passed around a pulley 25 freely rotatable about a horizontal axis disposed normal to the viewing plane, and anchored by way of conventional connecting means, denoted 26 in FIG. 7, to a pushing element 27 fashioned from a small rectangular plate bent downwards to a right angle along two longitudinal generators in such a way as to create a cross sectional profile substantially of upturned U shape (see also FIG. 2). The pushing element 27 is accommodated within the upper channel element 16, straddling the upper portion 20 of the guide bar 18 and slidable thus along its own axis. The pulley 25 is supported from one side only by one of the two ribs 22 or 23 (that denoted 22, in the example of the drawings) for a reason that will become apparent.

Observing the end of the magazine assembly 13 on the left, as viewed in FIG. 1, it will be seen that the channel elements 15 and 16 are truncated in a vertical plane coinciding substantially with the right hand face presented by the flat rod 8 of the forcing element 7, and that the guide bar 18 is adjustable for axial position in relation to the tubular element 17 by means of a setscrew 28 or 29, according to the thickness S (measured in the same axial direction) of the fastener element 14*a*, 14*b*, 14*c*, 14*d* or 14*e* in use. The screw 28 or 29 engages a matching thread afforded by a relative portion of the lower channel element 15, and presents a conical point positioned to interact with a corresponding surface afforded by the guide bar 18 (see FIG. 7), in such a manner that the clearance between the butt end surface 18*t* of the bar 18 and a reference surface denoted 30*a* (FIG. 1) can be adjusted to the gauge of the particular staple or tack (which may vary even within a given series).

Referring again to FIG. 1, the left hand face of the vertical flat rod 8 descends effectively flush with a parallel surface (that denoted 30*a*) afforded by a restraint element 30, consisting essentially of a vertically disposed plate 31 connected to the vertical housing 6 and extending down to terminate at a level below that of the magazine assembly 13. The plate 31 of the restraint element 30, which in effect provides the means of guiding and releasing each fastener element ejected, is fashioned with a vertically disposed slot 32 (see FIG. 3) occupying a substantially median position in relation to the transverse dimension of the appliance and partially accommodating a tension element 33' embodied as a leaf spring, of which the top part is supported by the restraint element 30 and a lower portion passes through the slot 32 and toward the adjacent end of the tubular element 17.

As illustrated in FIGS. 4 to 6, and particularly in FIG. 5, the plate 31 of the restraint element 30 affords two vertical grooves 33 and 34 fashioned in the surface directed toward the tubular element 17, respectively on the left and on the right as viewed in the drawings in question. The grooves 33 and 34 have dissimilar widths L1 and L2 (respectively proportional to and mirroring the widths of the two gaps 20*c* and 20*d* aforementioned) and are positioned substantially in horizontal alignment with the two downwardly directed members 35 of the U-profiled pushing element 27, viewed in a direction parallel to the longitudinal axis of the tubular element 13. In like manner, the profile of the flat rod 8 is matched to the profile of the plate 31, affording a longitudinal recess 8*a* in the central area partly accommodating the spring 33', and on either side, two projections 8*c* and 8*d* disposed and proportioned to mirror the position and widths L1 and L2 of the respective grooves 33 and 34.

FIG. 8 shows an alternative embodiment to that described and illustrated thus far, in which the plate 31 has two grooves 32*a* and 32*b*, set marginally apart one from the other and serving to accommodate two small leaf springs 33*a* and 33*b* of which the respective lower ends are independent, though the top ends will be associated preferably with a single flexible element. While equivalent in concept to the main solution, this arrangement has the advantage that fastener elements of dissimilar dimensions can be accommodated more readily, and in particular: not only the broad staple 14*a* but also the medium staple 14*e* of width L3, and the narrow staple 14*b* of width L4; in this instance it will be one or the other of the two leaf springs 33*a* or 33*b* which provides the lateral restraint for the staple in question.

The operation of the appliance 1 according to the invention will now be described, with a brief reference only to the workings of those elements which also form a part of a conventional tacker.

While the particular manner in which different types of fastener element are accommodated by the appliance 1 is central to the disclosure, and will be described in due course, the method of operation remains the same as in a traditional gun, inasmuch as the fasteners 14*a* . . . *e* are purchased in the form of a refill 36 consisting in a strip of the single elements attached one to another and bonded, for example by an application of adhesive material; the strip is loaded into the tubular element 17 and directed gradually toward the restraint element 30 by the pushing element 27 through the force of the spring 24 as the fasteners are consumed. In effect, each time the trigger 10 is squeezed to connect the actuator element 9 with the air supply 5, a single fastener will be driven downward by the forcing element 7 at a point immediately adjacent to the restraint 30, and punched through the object (not illustrated) to be secured.

As seen in FIGS. 2 to 9, the fastener elements 14*a*, 14*b*, 14*c*, 14*d* and 14*e* considered by way of example for the purpose of the description consist respectively of a broad staple, a narrow staple, a brad, a sprig and a medium width staple.

In the case of the user wishing to operate the gun 1 with the broad staple type of element 14*a*, it suffices to load a refill 36 of these same staples (see FIG. 5) into the tubular element 17, positioned in such a way that the top and side faces of the guide bar 18 are compassed substantially in their entirety. In this situation, the staples 14*a* are advanced toward the restraint 30 and applied to the selected support in exactly the same manner as for a conventional gun, with the refill 36 riding along the guide bar 18 as the single staples are used up, and without any possibility of the refill or of the single elements 14*a* losing their position. It will be observed that, as each staple 14*a* is driven down by the action of the forcing element 7, the lower end of the leaf spring 33' retracts completely into the slot 32, performing no function whatever.

In the event of the user wishing to operate the gun 1 with the narrow staple type of element 14*b*, it suffices to position the appropriate refill 36 (see FIG. 4) in the tubular element 17 in such a manner that only the top face and the sides of the single rib 23 are encompassed. In this situation, the staples 14*b* advance toward the restraint 30 of the appliance 1 and are applied to the support in the usual manner, though sliding along one rib 23 only of the guide bar 18. The leaf spring 33' now performs a fundamental role in the operation of the gun, by virtue of the fact that the bottom end is able to occupy and maintain its position in the slot 32 (see FIG. 3) without any interference from the staple 14*b* descending under the action of the forcing element 7. Accordingly, this same bottom end of the leaf spring 33' assumes a position in which a portion of one edge is offered in contact to the lateral surface (the left hand surface in FIG. 3) of the descending staple 14*b*, whereas the staple 14*b*, moving downward between the end of the bar 18 and the restraint element 30 and no longer held straight by the rib 23, would not otherwise be sufficiently supported and guided from the side in question and might be driven skew, emerging in an incorrect position. Thus, the spring 33' functions as a second restraint and lateral guide element when utilizing the narrow type of staple.

In the case of the medium width staple 14*e*, it is the arrangement of FIG. 8 that will be adopted (this solution is in fact valid for all five types of pin or staple referred to above, though clearly more complex), thereby exploiting the various size combinations afforded by the inclusion of the two separate leaf springs 33*a* and 33*b*.

In the case of the user wishing to operate the gun 1 with pointed fastener elements consisting of brads 14*c* or sprigs 14*d*, it suffices to insert the corresponding refill 36 (FIG. 6) into the tubular element 17 in a position alongside one respective flank of the guide bar 18 (occupying the relative gap 20*c* or 20*d*). In this instance, the elements 14*c* or 14*d* advance toward the restraint 30 and will be consumed in the normal fashion, with the refill 36 riding against the respective flank of the bar 18. As seen from FIG. 6, the element 14*c* or 14*d* in contact with the restraint element 30 is partly accommodated by the relative groove 33 or 34 and therefore guided positively to a given extent when driven downward by the forcing element 7, without drifting from its correct position; in effect, the plate 31 functions both as a restraint and a guide, with added assistance from the matching profile of the flat rod 8 as described above.

It will be evident from the foregoing that the stated object is fully realized in an appliance 1 according to the present invention, by virtue of its ability to operate in an extremely simple and economic manner with a generous number of different fastener elements belonging to a given nominal size range, even of dissimilar thicknesses.

No limitation is implied in the description and the accompanying illustrations; for example, the leaf spring 33' need not necessarily pass through the slot 32, but might occupy the space partially and thus remain concealed from the exterior.

I claim:

1. An appliance for driving a pointed elongated fastening element from a strip of a plurality of such elements comprising:

a vertically disposed hollow body having a bottom end;

a magazine having a fastener exit end associated with the bottom end of said hollow body;

a tubular element within said magazine for holding in its interior a strip of said fastener selected from a plurality of strips of fasteners of different widths and shapes, each fastener in a strip having the same width and length dimensions;

an elongated guide within said tubular element having a generally U-shaped cross-section along its length with two spaced lateral arms joined by a cross-piece, said arms spaced relative to said cross-piece to define with the interior of said tubular element a chase having a respective first and second passage of a corresponding first and second width between each said arm and the respective opposing interior surface of the tubular element and a third passage of a corresponding third width between said two arms, the respective widths of said first, second and third passages each being different to accommodate for movement along the length of the guide in the respective passages all or a part of the fasteners of a strip of fasteners entirely in a selected one of said first, second and third passages, in a combination of said first and second passages and extending over both of said arms, in a combination of said first and third passages and extending over one of said arms, and in a combination of said second and third passages and extending over the other of said arms;

a restraining element in said vertically disposed hollow body at and opposing the exit end of said magazine;

a pusher within said magazine to engage a strip of fasteners in the magazine and move the end fastener of a strip of fasteners in the magazine to the exit end against the restraining element said restraining element including a stabilizing member for engaging at least a part of the end fastener of a strip of fasteners in the magazine to stabilize the end fastener along at least a part of its length; and a forcing element in said hollow body to engage the end fastener at the exit end of the magazine positioned against said restraining element to separate it from the strip of fasteners and drive it out of the magazine.

2. An appliance as in claim 1, wherein said arms are spaced asymmetrically with respect to said guide cross-piece to provide said first and second passages of different widths.

3. An appliance as is claim 1 further comprising means for adjusting the spacing of said guide relative to said restraining element to accommodate fasteners of different thickness to be discharged from the exit and of said magazine.

4. An appliance for driving a pointed elongated fastening element from a strip of a plurality of such elements comprising:

a vertically disposed hollow body having a bottom end;

a magazine having a fastener exit end associated with the bottom end of said hollow body;

a tubular element within said magazine for holding in its interior a strip of said fasteners selected from a plurality of strips of fasteners of different widths;

an elongated guide within said tubular element having a generally U-shaped cross-section along its length with two spaced lateral arms joined by a cross-piece, each said arm of said guide having a cross-section of different width to form said first and second passages of different widths, said arms spaced relative to said cross-piece to define with the interior of said tubular element a chase having a respective first and second passage of a corresponding first and second width between each said arm and the respective opposing interior surface of the tubular element and a third passage of a corresponding third width between said two arms, the respective widths of said first, second and third passages each being different to accommodate for movement along the length of the guide in the respective passages all or a part of the fasteners of a strip of fasteners in a selected one of said first, second and third passages, in a combination of said first and second passages and extending over both of said arms, in a combination of said first and third second and third passages and extending over the other of said arms;

a restraining element in said vertically disposed hollow body at and opposing the exit end of said magazine;

a pusher within said magazine to engage a strip of fasteners in the magazine and move the end fastener of a strip of fasteners in the magazine to the exit end against the restraining element; and a forcing element in said hollow body to engage the end fastener at the exit end of the magazine positioned against said restraining element to separate it from the strip of fasteners and drive it out of the magazine.

5. An appliance as in claim 4, wherein said arms are spaced asymmetrically with respect to said guide cross-piece.

6. An appliance for driving a pointed elongated fastening element from a strip of a plurality of such elements comprising:

a vertically disposed hollow body having a bottom end;

a magazine having a fastener exit end associated with the bottom end of said hollow body;

a tubular element within said magazine for holding in its interior a strip of said fasteners selected from a plurality of strips of fasteners of different widths and shapes, each fastener of a strip having the same width and length dimensions;

an elongated guide within said tubular element having a generally U-shaped cross-section along its length with two spaced lateral arms joined by a cross-piece, said arms spaced relative to said cross-piece to define with the interior of said tubular element a chase having a respective first and second passage of a corresponding first and second width between each said arm and the respective opposing interior surface of the tubular element and a third passage of a corresponding third width between said two arms, said first and second widths being different from each other and said third width being different from at least one of said first and second widths to accommodate for movement along the length of the guide in the respective passage all or a part of the fasteners of a strip of fasteners in a selected one of said first, second and third passages, in a combination of said first and second passages and extending over both of said arms, in a combination of said first and third passages and extending over one of said arms, and in a combination of said second and third passages and extending over the other of said arms;

a restraining element in said hollow body at the exit end of said magazine;

a pusher within said magazine to engage a strip of fasteners in the magazine and move the end fastener of a strip of fasteners in the magazine against the restraining element;

a forcing element in said hollow body to engage the end fastener at the exit end of the magazine positioned against said restraining element to separate it from the strip of fasteners and drive it out of the magazine; and a resilient stabilizing member extending vertically on said restraining element opposing the fastener exiting from said magazine for engaging a side of the end fastener of the strip along at least a part of its length to provide vertical lateral stability to the end fastener of a strip of fasteners.

7. An appliance as in claim 6 wherein said stabilizing member comprises a resilient element having a vertically extending edge positioned opposing said third passage of said guide to engage a side of one leg of a staple type fastener in said third passage moving over one of said arms of said guide.

8. An appliance as in claim 6 wherein said resilient stabilizing member comprises at least one leaf spring extending outward of said restraining element toward said magazine positioned for a vertically extending edge thereof to engage a side of a fastener.

9. An appliance as in claim 8 that drives staple type fasteners formed of two legs connected by a cross-arm and wherein said at least one leaf spring is depressed by the cross arm of a staple type fastener of a strip of fasteners whose legs are in said guide third passage or in the combination of said first and second passages.

10. An appliance as set forth in claim 8 wherein each said arm of said guide has a cross-section of different width to make said first and second passages of different widths and wherein said at least one leaf spring is located on said restraining element opposing and aligned with said guide third passage and has a width less than said third width to accommodate a staple type fastener moving over a said arm of said guide.

11. An appliance as set forth in claim 8 wherein each said arm of said guide forms first and second passages of different widths and said at least one leaf spring is located on said restraining element opposing and aligned with said guide third passage and has a width less than said third width to accommodate a staple type fastener moving over one of said arms of said guide, said at least one leaf spring being off-center with respect to said third passage.

12. An appliance as in claim 8 wherein said restraining element has a vertical groove for housing said at least one leaf spring.

13. An appliance as set forth in claim 6, wherein said stabilizing member is a leaf spring located on said restraining element opposing and aligned with said guide third passage and having a width less than said third width of said guide to accommodate a staple fastener moving over said arm of said guide.

14. An appliance as is claim 6 further comprising means for adjusting the spacing of said guide relative to said restraining element to accommodate fasteners of different thickness to be discharged from the exit and of said magazine.

15. An appliance for driving a pointed elongated fastening element from a strip of a plurality of such elements comprising:

a vertically disposed hollow body having a bottom end;

a magazine having a fastener exit end associated with the bottom end of said hollow body;.

a tubular element within said magazine for holding in its interior a strip of said fasteners selected from a plurality of strips of fasteners of different widths;

an elongated guide within said tubular element having a generally U-shaped cross-section along its length with two spaced lateral arms joined by a cross-piece, said arms spaced relative to said cross-piece to define with the interior of said tubular element a chase having a respective first and second passage of a corresponding first and second width between each said arm and the respective opposing interior surface of the tubular element and a third passage of a corresponding third width between said two arms, at least said third width being different from said first and second widths to accommodate for movement along the length of the guide in each respective passage all or a part of the fasteners of a strip of fasteners in a selected one of said first, second and third passages, a combination of said first and second passages and extending over both of said arms, in a combination of said first and third passages and extending over one of said arms, and in a combination of said second and third passages and extending over the other of said arms;

a restraining element in said vertically disposed hollow body at the exit end of said magazine;

a pusher within said magazine to engage strip a of fasteners in the magazine and move the end fastener of a strip of fasteners in the magazine against the restraining element;

a forcing element in said hollow body to engage the end fastener at the exit end of the magazine positioned against said restraining element to separate it from the strip of fasteners and drive it out of the magazine;

a stabilizing member extending vertically on said restraining element and opposing the fastener exiting from said magazine for engaging a side of the end fastener of the strip along at least a part of its length to provide vertical lateral stability to the end fastener of a strip of fasteners having a width less than the width between said first and second passages of said guide, where said stabilizing member comprises a resilient element having a vertically extending edge positioned opposing said third passage of said guide to engage a side of one leg of a staple type fastener in said third passage moving over one of said arms of said guide, and wherein said resilient element comprises a pair of leaf springs spaced side-by-side on said restraining element opposing and aligned with said guide third passage, a respective one of said pair of leaf springs to engage a fastener having a portion moving in a respective one of said first and second passages.

16. An appliance for driving a pointed elongated fastening element from a strip of a plurality of such elements comprising:

a vertically disposed hollow body having a bottom end;

a magazine having a fastener exit end associated with the bottom end of said hollow body;

a tubular element within said magazine for holding in its interior a strip of said fasteners selected from a plurality of strips of fasteners of different widths;

an elongated guide within said tubular element having a generally U-shaped cross-section along its length with two spaced lateral arms joined by a cross-piece, said arms spaced relative to said cross-piece to define with the interior of said tubular element a chase having a respective first and second passage of a corresponding first and second width between each said arm and the respective opposing interior surface of the tubular element and a third passage of a corresponding third width between said two arms, at least said third width being different from said first and second widths to accommodate for movement along the length of the guide in the respective passage all or a part of the fasteners of a strip of fasteners in a selected one of said first, second and third passages, a combination of said first and second passages and extending over both of said arms, in a combination of said first and third passages and extending over one of said arms, and in a combination of said second and third passages and extending over the other of said arms;

a restraining element in said vertically disposed hollow body at the exit end of said magazine;

a pusher within said magazine to engage a strip of fasteners in the magazine and move the end fastener of a strip of fasteners in the magazine against the restraining element;

a forcing element in said hollow body to engage the end fastener at the exit end of the magazine positioned against said restraining element to separate it from the strip of fasteners and drive it out of the magazine;

a stabilizing member extending vertically on said restraining element and opposing the fastener exiting from said magazine for engaging a side of the end fastener of the strip along at least a part of its length to provide vertical lateral stability to the end fastener of a strip of fasteners having a width less than the width of a said first and second passage of said guide, and wherein said stabilizing member comprises a vertical groove on said restraining element aligned with and opposing a respective one of said first and second passages to accept the end fastener of a strip of brad type fasteners of a width corresponding to a respective one of said first and second widths.

17. An appliance as in claim 16 wherein said first and second passages have respectively different widths and said stabilizing member comprises a pair of spaced vertical grooves on the face of said restraining element aligned with and opposing a respective said first and second passage of said guide to accept the end fastener of a strip of brad type fasteners of a width corresponding to the respective one of said first and second widths, and a resilient element on said restraining element aligned with and opposing at least a part of said third passage of said guide.

18. An appliance as in claim 16 wherein said stabilizing member further comprises a respective vertical groove on the face of said restraining element aligned with and opposing each of said first and second passages to accept the end fastener of a strip of brad type fasteners of a width corresponding to a respective one of said first and second widths.

19. An appliance for driving a pointed elongated fastening element from a strip of a plurality of such elements comprising:

a vertically disposed hollow body having a bottom end;

a magazine having a fastener exit end associated with the bottom end of said hollow body;

a tubular element within said magazine for holding in its interior a strip of said fastener selected from a plurality of strips of fasteners of different widths;

an elongated guide within said tubular element having a generally U-shaped cross-section along its length with two spaced lateral arms joined by a cross-piece, said arms spaced relative to said cross-piece to define with the interior of said tubular element a chase having a respective first and second passage of a corresponding first and second width between each said arm and the respective opposing interior surface of the tubular element and a third passage of a corresponding third width between said two arms, at least said third width being different from said first and second widths to accommodate for movement along the length of the guide in the respective passage all or a part of the fasteners of a strip of fasteners in a selected one of said first, second and third passages, a combination of said first and second passages and extending over both of said arms, in a combination of said first and third passages and extending over one of said arms, and in a combination of said second and third passages and extending over the other of said arms;

a restraining element in said vertically disposed hollow body at the exit end of said magazine;

a pusher within said magazine to engage a strip of fasteners in the magazine and move the end fastener of a strip of fasteners in the magazine against the restraining element;

a forcing element in said hollow body to engage the end fastener at the exit end of the magazine positioned against said restraining element to separate it from the strip of fasteners and drive it out of the magazine;

a stabilizing member extending vertically on said restraining element and opposing the fastener exiting from said magazine for engaging a side of the end fastener of the strip along at least a part of its length to provide vertical lateral stability to the end fastener of a strip of fasteners having a width less than the width between said first and second passages of said guide and wherein said stabilizing member comprises a recess defining side walls on the restraining element of a width corresponding substantially to said third width to accept a staple type fastener having legs spaced apart by a distance of substantially said third width that moves in the space between said two arms of said guide with the legs of the end fastener of the strip stabilized by the side walls of the recess.

20. An appliance as in claim 19 wherein said stabilizing member further comprises a leaf spring on said restraining element having a vertical edge for engaging a leg of a staple type fastener of a strip of fasteners moving over one of said arms of said guide.

* * * * *